US007909746B2

(12) United States Patent
Gant

(10) Patent No.: US 7,909,746 B2
(45) Date of Patent: Mar. 22, 2011

(54) PUSH-UP EXERCISE APPARATUS

(76) Inventor: Clifford Ernest Gant, Lake Havasu City, AZ (US)

( * ) Notice: Subject to any disclaimer, the term of this patent is extended or adjusted under 35 U.S.C. 154(b) by 0 days.

(21) Appl. No.: 12/317,211

(22) Filed: Dec. 18, 2008

(65) Prior Publication Data

US 2010/0279833 A1 Nov. 4, 2010

(51) Int. Cl.
*A63B 71/00* (2006.01)

(52) U.S. Cl. ..... 482/141; 482/62

(58) Field of Classification Search ..... 482/34, 482/62, 139, 51, 23, 79, 91, 141, 44–45, 482/132, 126, 135–136, 146–147; D21/662, D21/665, 677, 684–685, 689, 698
See application file for complete search history.

(56) References Cited

U.S. PATENT DOCUMENTS 3,604,722 A * 9/1971 Boley ..... 280/87.01
4,193,592 A * 3/1980 Bishow ..... 472/14
4,291,873 A * 9/1981 Lee et al. ..... 482/147
4,429,869 A * 2/1984 Eckstein ..... 482/71
4,610,448 A * 9/1986 Hill ..... 482/141
4,618,145 A * 10/1986 Inada ..... 482/146
4,759,542 A * 7/1988 Hudec ..... 482/34
4,768,778 A * 9/1988 Thomas, Jr. ..... 482/141
4,858,918 A * 8/1989 Iams et al. ..... 482/132
5,358,463 A * 10/1994 Fuentes ..... 482/141
D374,045 S * 9/1996 Ward, III ..... D21/686
5,582,567 A * 12/1996 Chang ..... 482/146
5,632,707 A * 5/1997 Daniel et al. ..... 482/8
6,176,817 B1 * 1/2001 Carey et al. ..... 482/146
6,945,920 B1 9/2005 Kemery et al.
7,052,449 B2 * 5/2006 Chen ..... 482/146
7,137,938 B2 11/2006 Gottlieb
7,175,577 B2 * 2/2007 Greenspan et al. ..... 482/146
7,357,767 B2 4/2008 Tsai
7,374,517 B2 * 5/2008 Lockett ..... 482/131
7,377,888 B2 * 5/2008 Godbold ..... 482/141
7,468,025 B2 * 12/2008 Hauser et al. ..... 482/141
7,503,884 B1 * 3/2009 Schall ..... 482/141
7,553,567 B2 * 6/2009 Morita ..... 429/12
2006/0040809 A1 2/2006 Godbold

* cited by examiner

*Primary Examiner* — Lori Baker
(74) *Attorney, Agent, or Firm* — Andrew Y. Schroeder

(57) ABSTRACT

A Push-Up Exercise Apparatus includes a swiveling base, a handle, and an arcuate member. The swiveling base is connected with the arcuate member. The arcuate member base is comprised of a housing and a housing base. The housing is sized to accept the arcuate member. The handle is connected with the swiveling base.

1 Claim, 3 Drawing Sheets

100
195
102

100
101
115

100
115

100

100
195

100

100
135

100
601
600

600
602

655

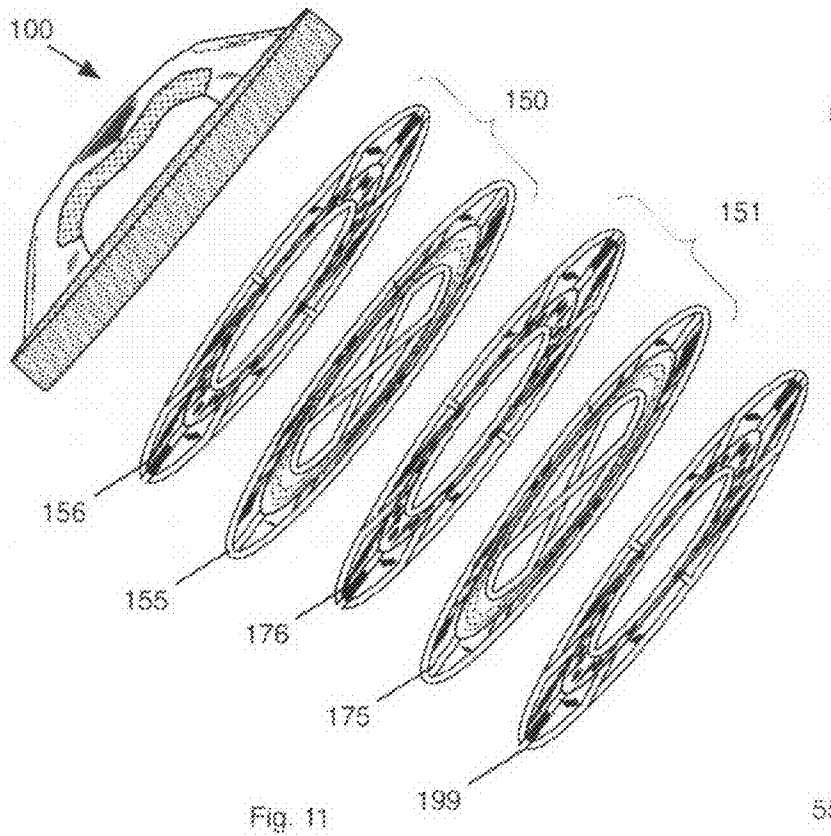
Fig. 11
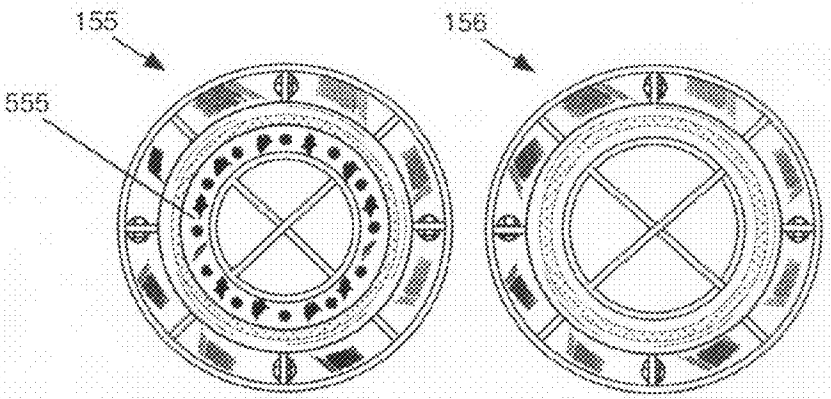
Fig. 12
Fig. 13
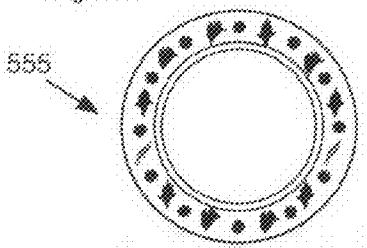
Fig. 14
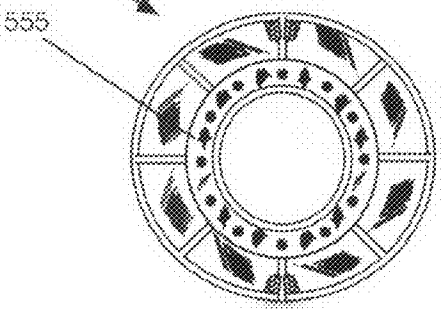
Fig. 15
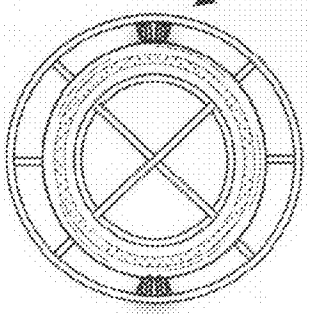
Fig. 16

PUSH-UP EXERCISE APPARATUS

FIELD OF THE INVENTION

The present invention is in the area of sporting goods and pertains more particularly to exercise equipment related with push-up exercises.

BACKGROUND OF THE INVENTION

One of the staple exercises performed in strength training is the push up. The push up is used to increase musculature in the upper body. Through the range of motion in a traditional push up, the pectorals, triceps, etc. are accessed in order to allow a person to vertically translate their body in an upwardly direction away from the ground.

The push up exercise is typically performed with a user's hands directly underneath their shoulders. Often, the elbows are disposed at a right angle with the upper arms disposed substantially parallel with the ground. As a result, the load displacement can be harsh for some user's with weakened wrists, elbows and attendant joints. These discomforts can ultimately discourage a person from performing push ups with proper technique.

In addition, another problem found in the exercise of a typical push up is the fact that push ups do not necessarily strengthen all of the muscles found in the upper body. Since the push up is typically performed at the same angle, only a fraction of a person's upper body muscles are firing in order to lift and lower a person's body during the exercise.

Therefore, what is clearly needed in the art is an apparatus which enables a user to access and target a larger number of upper body muscles with a modified push up utilizing a pronating push up apparatus. The apparatus should be customizable, and should enable a user to properly execute a proper push up.

SUMMARY OF THE INVENTION

It is an object of the present invention to provide an apparatus to modify the traditional push up exercise. The present invention enables a user to pronate his or her wrists, forearms, and upper arms throughout the push up exercise. This pronation, in turn, accesses the firing of more muscles in the pectorals, triceps, etc. Whereas the traditional push up exercise only enlists a fraction of the muscles, the present invention targets a larger number of muscles.

It is an object of the present invention to provide an exercise apparatus which trains the upper body muscles to attain "muscle memory" in the sense that the exercise apparatus forces a user to counterbalance him or herself to perform a push up. This "muscle memory" imparted to a user can be expedient in the application of various sporting activities.

It is an object of the present invention to enable a user to yield faster results with respect to the strength training of upper body muscles. By incorporating a larger range of muscles for the push up, a user will be able to strengthen more muscle groups more efficiently and effectively. The user will thereby be able to attain their workout goals in a shorter time period.

It is an object of the present invention to reduce the load or stress of a user's body weight upon the wrists, forearms, or other extremities. By enabling for pronation of a user's arms, less stress is placed upon said body parts. Moreover, the pronation of a user's arms may allow for a more diffused weight load on those body parts.

It is an object of the present invention to allow a user to increase their range of motion when performing the push up exercise. By increasing the range of motion throughout the exercise, a user will become more flexible, thereby augmenting their strength training exercises.

It is an object of the present invention to increase muscle performance for athletes desiring more power from their upper body. The present invention may impart greater upper body strength to those athletes who require more explosion from the muscle groups found in the upper body.

It is an object of the present invention to enable a user to increase core strength using an innovative rounded member (arcuate member). Through the use of the arcuate member, a person can increase his or her core strength, namely, the upper back muscles, the lower back muscles, and the abdominal muscles as well as other attendant muscle groups. The arcuate member forces a user to balance themselves, which, in turn enlists the usage of a wider array of core muscle groups found in the midsection of a person's body. These core muscle groups are important for the enhanced performance in golf, baseball, softball, tennis, etc.

BRIEF DESCRIPTION OF THE DRAWING FIGURES

FIG. 11 is an exploded view of a preferred embodiment of the present invention.

FIG. 12 is a plan view of a preferred embodiment of the present invention.

FIG. 13 is a plan view of a preferred embodiment of the present invention.

FIG. 14 is a plan view of a preferred embodiment of the present invention.

FIG. 15 is a plan view of a preferred embodiment of the present invention.

FIG. 16 is a plan view of a preferred embodiment of the present invention.

DESCRIPTION OF PREFERRED EMBODIMENTS

According to a preferred embodiment of the present invention, a unique apparatus is used for the purpose of enabling a person to strengthen their upper body core muscles with an improved push up exercise. The present invention is described in enabling detail below.

Figure 17:
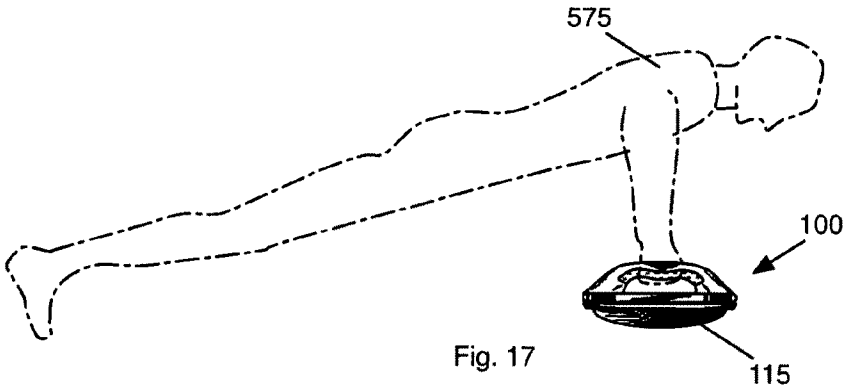
FIG. 17 is a side view of a preferred embodiment of the present invention.
Figure 18:
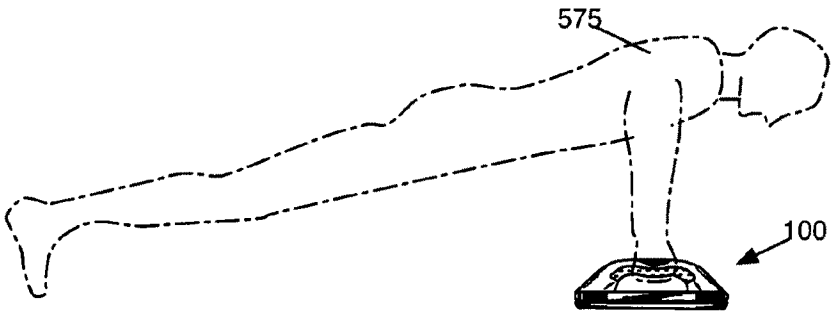
FIG. 18 is a side view of a preferred embodiment of the present invention.
Figure 19:
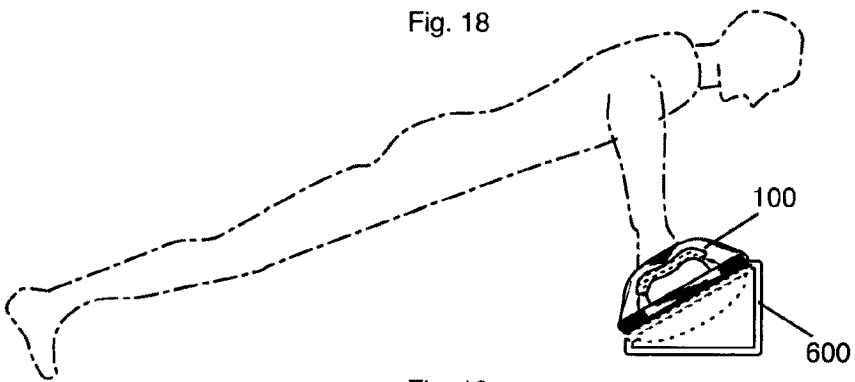
FIG. 19 is a side view of a preferred embodiment of the present invention.

FIGS. 1-15 illustrate a preferred embodiment of the present invention. An Improved Push-Up Exercise Apparatus for the purpose of strengthening core muscles in a person's 575 back, abdomen, and attendant muscle groups 100 includes a swiveling base 102, a handle 101, and an arcuate member 115. The swiveling base 102 is in communication with the arcuate member 115. The handle 101 is connected with the swiveling base 102. FIGS. 17-19 illustrate how the Push-Up Exercise Apparatus 100 is used in operation.

Figures 1, 2, 3, 4, 5, 6, 7, 8, 9, 10:
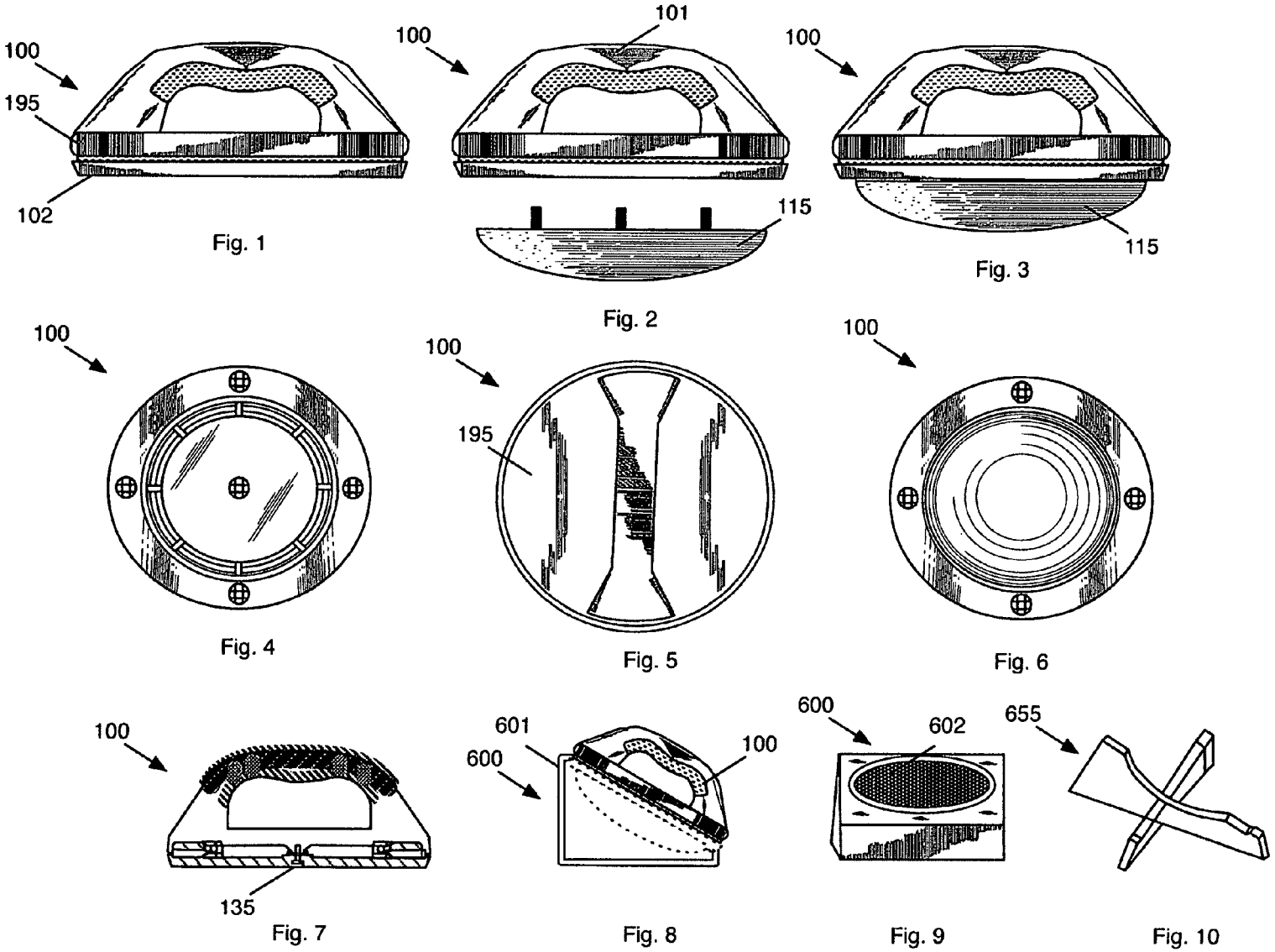
FIG. 1 is a side view of a preferred embodiment of the present invention.
FIG. 2 is a side view of a preferred embodiment of the present invention.
FIG. 3 is a side view of a preferred embodiment of the present invention.
FIG. 4 is a plan view of a preferred embodiment of the present invention.
FIG. 5 is a plan view of a preferred embodiment of the present invention.
FIG. 6 is a plan view of a preferred embodiment of the present invention.
FIG. 7 is a cross-section view of a preferred embodiment of the present invention.
FIG. 8 is a side view of a preferred embodiment of the present invention.
FIG. 9 is a front elevation view of a preferred embodiment of the present invention.
FIG. 10 is a perspective view of a preferred embodiment of the present invention.

In some preferred embodiments the swiveling base 102 is comprised of first swiveling assembly 150 and a second swiveling assembly 151. The first swiveling assembly 150 is comprised of a first ball thrust bearing plate 155 and a top plate 156. The first ball thrust bearing plate 155 is rotatably affixed to the top plate 156. The second swiveling assembly 151 is comprised of a second ball thrust bearing plate 175 and a cover plate 176. The second ball thrust bearing plate 175 is rotatably affixed to the cover plate 176. The first swiveling assembly 150 and second swiveling assembly 151 are in communication with the upper plate 195. The second swiveling assembly 151 is in communication with the posterior plate 199. Both the first ball thrust bearing plate 155 and the second ball thrust bearing plate 175 comprise a ball thrust bearing 555 as illustrated in FIG. 14. FIG. 7 illustrates that both the first swiveling assembly 150 and the second swiveling assembly 151 are rotatably disposed around a screw 135.

It should be pointed out here that in some preferred embodiments, the Push-Up Exercise Apparatus 100 may utilize other means of creating a "lazy susan" apparatus aside from ball thrust bearings. For this reason, the scope of the present invention is not meant to be limited to only ball thrust bearings.

FIGS. 8-10 illustrate that in some preferred embodiments the Push-Up Exercise Apparatus 100 may further include an arcuate member base 600 for the purpose of stabilizing the Push-Up Exercise Apparatus 100 for some users. The arcuate member base 600 is comprised of a housing 601 and a housing base 602. The housing 601 is sized to accept the arcuate member 115. FIG. 10 illustrates another preferred embodiment of a cross-member base 655.

It will be apparent to the skilled artisan that there are numerous changes that may be made in embodiments described herein without departing from the spirit and scope of the invention. As such, the invention taught herein by specific examples is limited only by the scope of the claims that follow.

What is claimed is:

1. A Push-Up Exercise Apparatus for the purpose of strengthening core muscles in a person's back, abdomen, and attendant muscle groups comprising:

a swiveling base, a handle, arcuate member base and an arcuate member;

the swiveling base is connected with the arcuate member;

the swiveling base is comprised of a first swiveling assembly and a second swiveling assembly;

the first swiveling assembly is comprised of a first ball thrust bearing plate and a top plate;

the first ball thrust bearing plate is rotatably affixed to the top plate;

the second swiveling assembly is comprised of a second ball thrust bearing plate and a cover plate;

the second ball thrust bearing plate is rotatably affixed to the cover plate the arcuate member base is comprised of a housing and a housing base;

the arcuate member is detachable from the swiveling base;

the housing is sized to accept the arcuate member;

the handle is connected with the swiveling base.

* * * * *